United States Patent [19]

Bernard et al.

[11] Patent Number: 4,744,876

[45] Date of Patent: May 17, 1988

[54] ELECTROLYZER FOR EXTRACTING A SUBSTANCE FROM AN ELECTROLYTIC BATH

[75] Inventors: Robert Bernard, Grenoble; Georges Lonchampt, Meylan; Robert Tinti, Echirolles, all of France

[73] Assignee: Commissariat a l'Energie Atomique, Paris, France

[21] Appl. No.: 919,705

[22] Filed: Oct. 16, 1986

[30] Foreign Application Priority Data

Oct. 25, 1985 [FR] France ..... 85 15885

[51] Int. Cl.[4] ..... C25C 3/02

[52] U.S. Cl. ..... 204/245; 204/272; 204/275; 204/68

[58] Field of Search ..... 204/243 R–247, 204/68, 295, 272, 260, 263, 275

[56] References Cited

U.S. PATENT DOCUMENTS 2,111,264 3/1938 Gilbert ..... 204/68
2,944,950 7/1960 Hayes ..... 204/68
3,011,964 12/1961 Guillot ..... 204/295
3,248,311 4/1966 Wood ..... 204/68
3,776,823 12/1973 Crowther ..... 204/68 X

*Primary Examiner*—Donald R. Valentine
*Attorney, Agent, or Firm*—James E. Nilles; Thomas F. Kirby

[57] ABSTRACT

Electrolyzer for the extraction of a substance from an electrolytic bath.

The electrolyzer comprises an anode and a cathode immersed in the bath. The cathode, in which the substance is formed, surrounds the anode. The electrolyzer also comprises means for confining the substance in the vicinity of the cathode and for guiding said substance along and towards the upper end of the cathode, together with means for collecting the substance at said end. These confinement and guidance means comprises at least one grid layer located in the vicinity of the cathode and passing along the same.

Application to the production of alkaline metals or alkaline earth metals.

16 Claims, 2 Drawing Sheets

ELECTROLYZER FOR EXTRACTING A SUBSTANCE FROM AN ELECTROLYTIC BATH

BACKGROUND OF THE INVENTION

The present invention relates to an electrolyzer for extracting a substance from an electrolytic bath. It more particularly applies to the production fo alkaline metals such as lithium, sodium and potassium or alkaline earth metals such as beryllium, magnesium, calcium, strontium and barium, e.g. from the chlorides of these metals.

An electrolyzer is already known which makes it possible to produce lithium from an electrolytic bath containing lithium chloride. This known electrolyzer, diagrammatically shown in FIG. 1*a*, essentially comprises in the electrolyzer body 2 for filling with the electrolytic bath 3, an anode 4, a metal cathode 6 surrounding the anode, a metal collector 8 in the form of an inverted trough or channel, surmounting the upper end of the cathode and a metal diaphragm 10 which, placed between anode and cathode, is electrically insulated therefrom and extends downwards from the inner edge of the trough 8. The function of this diaphragm is to prevent the cathode-formed lithium from being entrained by the convection currents of the bath outside the space defined by the diaphragm, the cathode and collector 8.

A duct 12 forming an overflow passes through body 2 and issues in the trough permitting the evacuation of the lithium formed by electrolysis and accumulated in said trough (because its density is lower than that of the electrolytic bath. An outlet 14 for the chlorine formed during electrolysis is provided in the upper part of body 2 and a duct issuing into said body 2 in the upper part thereof is provided for introducing an inert gas, such as agron or lithium, into body 2 for preventing the recombination of the chlorine and the lithium and for permitting the discharge of the chlorine as a result of an appropriate inert gas pressure.

The electrolyzer of FIG. 1*a* can also have (FIG. 1*b*) an auxiliary anode 18 for polarizing the diaphragm 10 with respect to the electrolytic bath, so as to reduce corrosion of the diaphragm and collector 8, which are raised to the same potential.

The known electrolyzer described hereinbefore suffers from the disadvantage that the diaphragm 10 and cathode 6 are very frequently short circuited during electrolysis by the thrust on the cathode of lithium dendrites which end up by reaching the diaphragm. The lithium then forms on the latter and under these conditions it is at the same potential as the cathode. Therefore the lithium can become detached from the diaphragm in the space defined by the latter and the anode and can reach the electrolytic bath surface, where it partly recombines with the chlorine.

SUMMARY OF THE INVENTION

The present invention aims at obviating this disadvantage.

Thus, the present invention specifically relates to an electrolyzer for the extraction from an electrolytic bath of a substance which is less dense than said bath, said electrolyzer comprising an anode and a cathode which are immersed in the bath, the cathode, on which is formed the substance, extending vertically and surrounding the anode, the electrolyzer also having means for confining the substance in the vicinity of the cathode and for guiding said substance along and towards the upper end of the cathode, together with means for collecting the substance at said end, wherein the confinement and guidance means have at least one layer of a grid formed from a material resistant to the bath and the electrolysis products, each layer being disposed in the vicinity of the cathode, between the latter and the anode and extending along the cathode.

The substance, e.g. lithium in the case of the electrolysis of lithium chloride is consequently maintained in the vicinity of the cathode and is led towards the collecting means, where it can be discharged. Thus, the substance cannot reach the bath surface. In the case of the electrolysis of an alkali metal chloride, it is possible to prevent the metal formed from reaching said surface and therefore recombining with the chlorine.

The grating or grid layer or layers form to a certain extent an internal doubling of the cathode. Each layer can be electrically conductive (e.g. of a stainless metal, such as stainless steel) and electrically connected to the cathode. This is what takes place when the substance is electrically conductive (case of alkali metals which are liquid in the electrolytic bath) and the upper end of the layers are immersed in the substance accumulated in the collecting means. The substance formed with the cathode or on the grid is consequently confined in and between the grid layers and is then led by the latter to collecting means, where it accumulates.

It is possible to use several coaxial grid layers, e.g. several grids arranged in accordance with coaxial cylinders, or a single grid wound along a base cylinder in the form of a spiral, so that the single grid used is then shaped like a spiral, when viewed in section perpendicular to the generatrixes of the cylinder.

In the case where the confinement and guidance means comprise several layers, the respective heights of the lower ends of the layers, considered from the bottom of the cathode, can increase from the layer closest to the cathode, to take account of an accumulation of substance, which increases from bottom to top of the cathode. Thus, in the case of winding the grid in accordance with a spiral base cylinder, the lower edge of the grid is shaped like a helix wound on to a cone, which narrows towards the top.

Preferably, the collecting means comprise an inverted trough, which is placed above the cathode and whose outer edge passes along the upper end thereof and the upper end of each grid layer is sufficiently close to the trough to be immersed in the substance accumulated therein when the electrolyzer is operating, so that the "pump" formed by each grid layer with respect to the substance has a good flow rate.

Finally, in a preferred embodiment of the electrolyzer according to the invention, said electrolyzer also comprises means for the continuous supply of one component of the bath, which contains the substance.

BRIEF DESCRIPTION OF THE DRAWINGS

The present invention will be better understood from studying the following description of an embodiment of the electrolyzer according to the invention, with reference to FIG. 2, FIGS. 1*a* and 1*b* showing known electrolyzers which have already been described.

DETAILED DESCRIPTION OF THE INVENTION

Figure 1A:
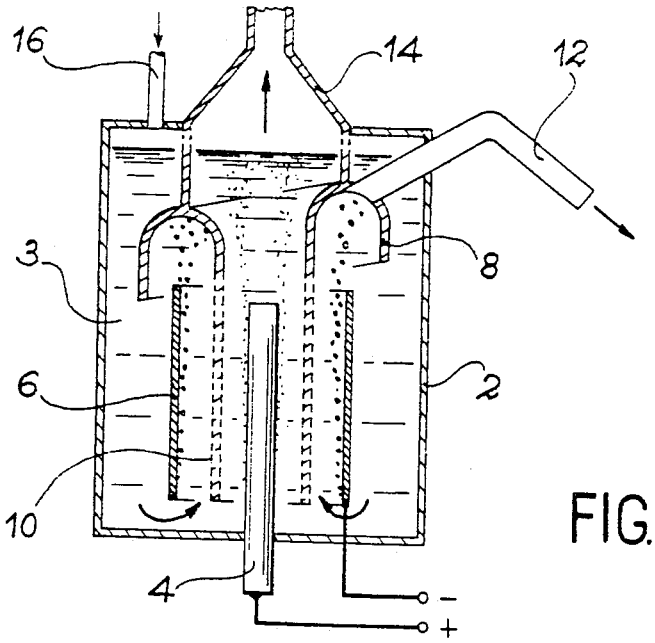
Figure 1B:
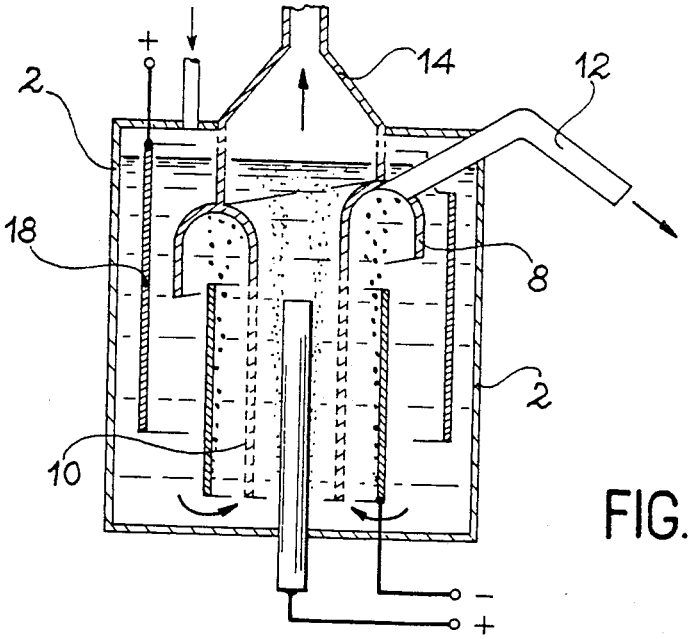
Figure 2:
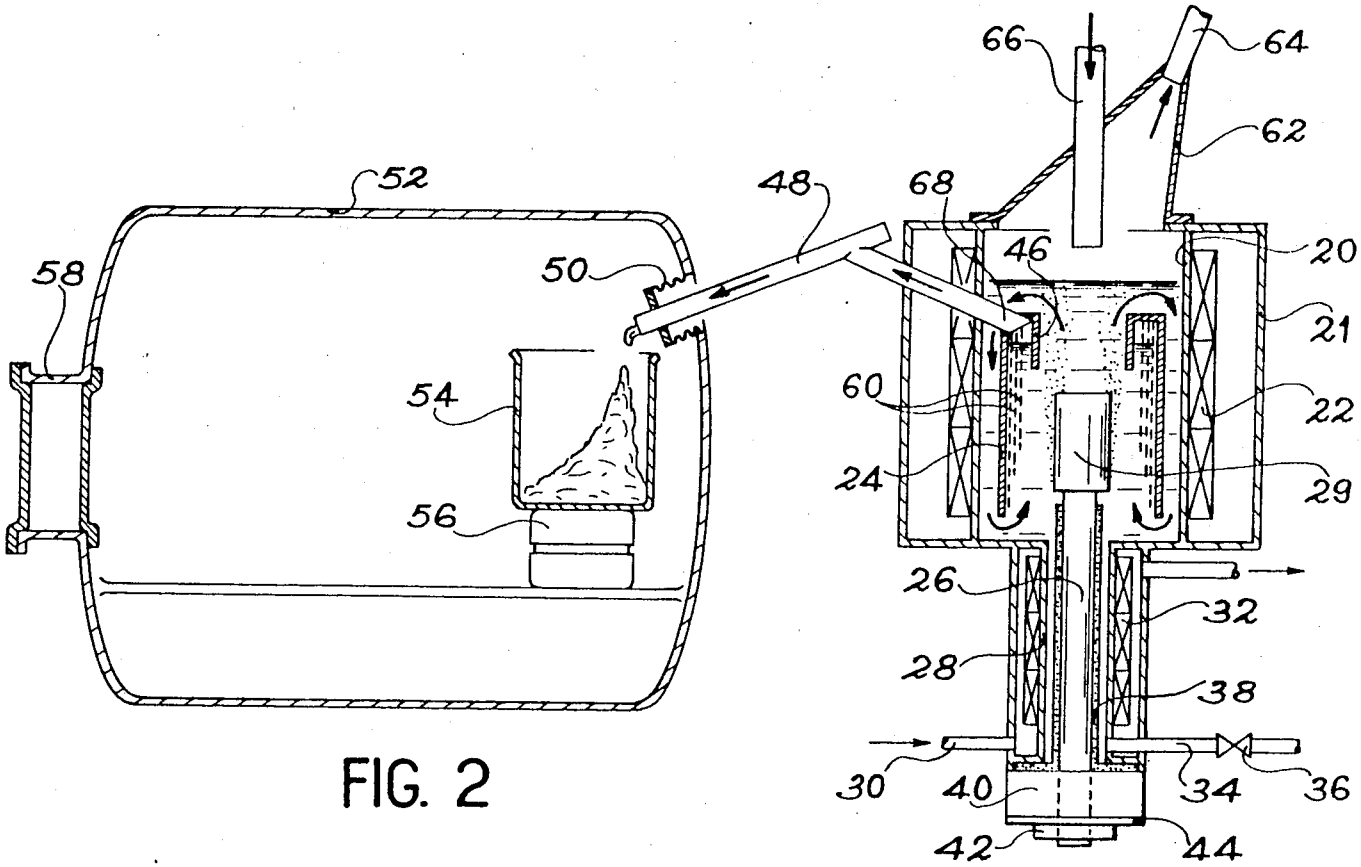

The electrolyzer according to the invention shown in FIG. 2 is e.g. intended for the production of lithium from lithium chloride and comprises an e.g. cylindrical tank 20 maintained in a tank support 21 and which contains a mixed bath of lithium chloride/potassium chloride in the molten state. The tank is raised to an appropriate temperature by heating means, such as heater bands 22 surrounding tank 20. Tank 20 is open in its upper part (and closed in its lower part).

The electrolyzer of FIG. 2 also comprises a cylindrical cathode 24 coaxial to the tank and located within the latter, together with an elongated anode 26, located along the tank axis. This cathode can be made from metal, e.g. nickel. The tank is extended at the bottom by a duct 28, which is closed at its lower end and disposed along the tank axis and issuing into said tank. The anode traverses this duct and e.g. expands in the tank up to mid-height of the cathode. The anode part 29 located in the tank can be expanded. Duct 28 is provided with cooling means 30, which e.g. constitute an air circulation, as well as heating means 32, such as heater bands located along duct 28. A pipe 34 for emptying the bath is provided at the bottom of duct 28, is linked with the latter and has a drain valve 36.

Except in its part 29, anode 26 is provided with a ceramic sheath 38, whereof the lower portion covers the base or lower end of duct 28. The lower end of the anode is threaded and projects beyond the base of duct 28. An electrically insulating ring 40 is mounted on said anode end and a nut 42 screwed to the base of the anode makes it possible to hold ring 40 against the ceramic sheath 38, by means of a metal washer 44.

The positive pole of a not shown d.c. power supply is connected to the lower end of the anode and the negative pole of said supply is connected to the cathode by means of a not shown electrically insulating passage passing through tank 20, which is also electrically insulated from the anode and the cathode.

The outer periphery of a circular trough-shaped inverted collector 46 is connected to the upper edge of the cathode. A duct 48 forming an overflow traverses support 21 and a not shown tight passage provided on the tank issues by one end into trough 46. The other end of overflow 48 enters via a sealing bellows 50 a tight enclosure 52, such as a glove box, which is filled with a gas which does not chemically react with lithium, e.g. argon. A receptacle 54 is placed in container 52 under the other end of overflow 48 and can rest on a continuous weighing apparatus 56. Enclosure 52 is provided with a lock 58 making it possible to intervene in said container and extract receptacle 54 therefrom.

Several coaxial, cylindrical grids 60 extend along and in the vicinity of the inner wall of the cathode facing the anode, from the interior of trough 46 down to the bottom of the cathode, the respective heights of the lower ends of the grids, from the bottom of the cathode, increasing from the grid closest to the cathode.

As a non-limitative statement, the grids are in contact, the gap between them being zero and the grid closest to the cathode is in contact with the latter, each grid having a thickness of 0.6 cm and being produced from 0.25 cm diameter wires, forming square meshes of side length 0.5 cm.

The upper part of tank 20 is tightly closed by a hood-like cover 62, whose top is tightly connected to a duct 64. The end of a pipe 66, which supplies the bath with one of its components, containing the substance, and which traverses the hood 62 by a not shown tight passage issues into the upper part of the tank above the electrolytic bath surface filling the tank whilst covering the anode, cathode, trough and part 68 of the overflow present in the tank.

The bath is subject to the action of rising and falling convection currents respectively along the inner and outer walls of the cathode, passages being provided between the latter and the bottom of the tank for the circulation of the bath.

During electrolysis, the chlorine which is given off by the cathode is discharged by pipe 64. The liquid lithium formed on the cathode rises along the same and grids 60, accumulating in trough 46, from where it is discharged by overflow 48. The lithium then falls into receptacle 54, which can be extracted from enclosure 52 by lock 58, when an adequate lithium quantity, measured by continous weighing means 56, is contained in receptacle 54.

Tank 20, its support 21, cover 62, duct 28, cathode 24, anode 26, trough 46 and grids 60 are e.g. made from stainless steel.

The absence of any obstacle to the rising movement of the chlorine bubbles in that part of the bath located between the anode and the bath surface (the anode current arrives through the bottom of the electrolyzer) leads to an adequate bath rise speed in said part to ensure, between cathode and inner wall of the tank, a good downward circulation of the electrolyte and therefore an excellent replenishment of the bath in the electrolysis zone between anode and cathode.

In order to reduce the cost of the electrolyzer, the cathode, collector 46 and overflow part 68, which are constantly immersed in the bath, can be made from a less noble metal than the tank and cover, said metal being e.g. ordinary steel.

If it is possible to avoid the dilution by a gas of the chlorine formed and consequently its possible humidification, it is possible to reduce the corrosion of the tank and its cover. The compression, storage and marketing of the chlorine formed can then be envisaged.

The lithium layer present in the collector must not drop too far in it, because otherwise there would be a risk of it escaping through the open bottom part of the collector.

It is preferable for the bath height, which is dependent on the position of the overflow and the apparent density of the bath at collector 46, said density being a function of the chlorine quantity present at this level, varies by no more than roughly one centimeter. It is also preferable to continuously supply the bath with dry lithium chloride by duct 66.

The electrolyzer according to the invention, described with reference to FIG. 2, has an excellent overall lithium yield and permits a continuous production thereof by preventing the formation of short circuits between anode and cathode. The corrosion of the cathode, grids and collector 46 is greatly reduced in said electrolyzer. Finally, the marketing of the chlorine produced at the same time as the lithium is possible.

What is claimed is:

1. An electrolyzer for the extraction from an electrolytic bath of a substance which is less dense than said bath, said electrolyzer comprising an anode and a cathode which are immersed in the bath, the cathode, on which is formed the substance, extending vertically and surrounding the anode, the electrolyzer also having means for confining the substance in the vicinity of the cathode and for guiding said substance along and towards the upper end of the cathode, together with means for collecting the substance at said end, wherein the confinement and guidance means have at least one layer of a grid formed from an electrically conductive material resistant to the bath and the electrolysis products, and wherein each layer is disposed in the vicinity of the cathode, between the latter and the anode, extends along the cathode and forms an internal doubling of said cathode.

2. An electrolyzer according to claim 1, wherein said confinement and guidance means comprise several coaxial grid layers.

3. An electrolyzer according to claim 1, wherein said grid is wound in accordance with a spiral base cylinder.

4. An electrolyzer according to claim 1 wherein the respective heights of the lower ends of the grid layers, considered from the bottom end of said cathode, increase from the grid layer closest to said cathode.

5. An electrolyzer according to claim 1, wherein the collecting means comprise an inverted trough having an outer peripheral edge, said trough being mounted in said electrolyzer above said cathode, with said outer peripheral edge positioned along said upper end of said cathode and wherein each grid layer has an upper end and is mounted in said electrolyzer to have said upper end terminate in said trough so as to be immersed in said substance accumulated in said trough when the electrolyzer is operating.

6. An electrolyzer according to claim 1, wherein a means is provided for the continuous supply of one component of said bath, which contains said substance.

7. An electrolyzer according to claim 1 wherein said collecting means comprises an inverted trough having a top portion terminating in depending spaced apart inner and outer edges and wherein each grid layer has an upper end which faces said top portion.

8. An electrolyzer according to claim 7 wherein said depending outer edge of said inverted trough passes along said upper end of said cathode.

9. An electrolyzer for the extraction from an electrolytic bath, of a substance which is less dense than said bath, said electrolyzer comprising:

a tank adapted to contain said bath;

an anode and a cathode mounted in said tank in a position to be immersed in said bath, said cathode, on which said substance is formed, having bottom and upper ends and mounted to extend vertically in said tank in spaced surrounding relation to said anode;

a confinement and guidance means mounted in said tank for confining said substance in the vicinity of said cathode and for guiding said substance along and towards said upper end of said cathode;

an inverted collecting trough having a top portion terminating in depending spaced apart inner and outer edges, said trough mounted in said tank for collecting said substance at said upper end of said cathode; and wherein the improvement comprises said confinement and guidance means having at least two layers of grids each of which includes an upper and lower end formed from a material resistant to said bath and said substance, and said upper end of each grid layer being mounted to suspend vertically downward from said top portion of said trough and extend along said cathode between the latter and said anode.

10. An electrolyzer according to claim 9 wherein said outer edge of said inverted trough is in registry with said upper end of said cathode and extends radially inward toward said anode.

11. An electrolyzer according to claim 9 wherein said grid layers are in contact with each other.

12. An electrolyzer according to claim 9 wherein said grid includes several grid layers comprised of coaxial cylinders.

13. An electrolyzer according to claim 9 wherein said several grid layers are comprised of a single grid shaped like a spiral wound along a base cylinder, said grid lower end being in the form of a helix wound on a cone which narrows from said cathode bottom end toward said upper end thereof.

14. An electrolyzer for the extraction from an electrolytic bath of a substance which is less dense than said bath, said electrolyzer comprising a tank adapted to contain said bath, an anode and a cathode mounted in said tank in a position to be immersed in said bath, said cathode, on which said substance is formed, having bottom and upper ends extending vertically in said tank in spaced surrounding relation to said anode, confining and guiding means mounted in said tank for confining said substance in the vicinity of the cathode and for guiding said substance along and towards said upper end of said cathode, and a collecting means mounted in said tank for collecting said substance at said upper end of said cathode, wherein the improvement comprises said confinement and guidance means including at least two coaxial grid layers formed from a material resistant to said bath and said substance with each grid layer having an upper and a lower end, said layers being mounted in said tank to extend along said cathode, between the latter and said anode, said lower grid ends having their respective distances, as considered from said bottom end of said cathode, increase from the grid layer closest to said cathode.

15. An electrolyzer for the extraction from an electrolytic bath of a substance which is less dense than said bath, said electrolyzer comprising an anode and a cathode which are immersed in said bath, said cathode, on which is formed the substance, having an upper end and extending vertically in spaced surrounding relation to said anode, the electrolyzer also having means for confining said substance in the vicinity of said cathode and for guiding said substance along and towards said upper end of said cathode, together with means for collecting said substance at said upper end, wherein said confinement and guiding means have at least one layer of a grid formed from an electrically conductive material resistant to the bath and the electrolysis products, and wherein each layer is disposed in the vicinity of the cathode, between the latter and the anode, extends along the cathode and forms an internal doubling of said cathode, the grid layer closest to said cathode being in contact with said cathode.

16. An electrolyzer for the extraction from an electrolytic bath of a substance which is less dense than said bath, said electrolyzer comprising an anode and a cathode which are immersed in said bath, said cathode, on which is formed the substance, having an upper end and extending vertically in spaced surrounding relation to said anode, the electrolyzer also having means for confining said substance in the vicinity of said cathode and for guiding said substance along and towards said upper end of said cathode, together with means for collecting said substance at said upper end, wherein the confinement and guiding means comprise a single grid wound along a base cylinder in the form of a spiral, said grid being formed from an electrically conductive material resistant to the bath and the electrolysis products, and wherein said grid is disposed in the vicinity of the cathode, between the latter and the anode, extends along the cathode and forms an internal doubling of said cathode.

* * * * *